US011208768B2

(12) United States Patent
Impola et al.

(10) Patent No.: US 11,208,768 B2
(45) Date of Patent: Dec. 28, 2021

(54) AUTONOMOUS SOIL COMPACTOR FRONT RADAR

(71) Applicant: Caterpillar Paving Products Inc., Brooklyn Park, MN (US)

(72) Inventors: Todd A. Impola, Minnetonka, MN (US); John L. Marsolek, Watertown, MN (US); Timothy M. O'Donnell, Long Lake, MN (US); Jacob J. McAlpine, Otsego, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 3 days.

(21) Appl. No.: 16/813,107

(22) Filed: Mar. 9, 2020

(65) Prior Publication Data

US 2021/0277610 A1 Sep. 9, 2021

(51) Int. Cl.

| | |
|---|---|
| ***E01C 19/00*** | (2006.01) |
| ***E01C 19/28*** | (2006.01) |
| ***E01C 19/26*** | (2006.01) |
| *E02D 3/026* | (2006.01) |

(52) U.S. Cl.

CPC ..... *E01C 19/285* (2013.01); *E01C 19/004* (2013.01); *E01C 19/26* (2013.01); *E02D 3/026* (2013.01)

(58) Field of Classification Search

CPC ..... E01C 19/004; E01C 19/26; E01C 19/285; E02D 3/026

USPC ..... 404/72, 75, 117

See application file for complete search history.

(56) References Cited

U.S. PATENT DOCUMENTS

| | | | | | |
|---|---|---|---|---|---|
| 4,098,344 | A * | 7/1978 | Johnson | E02D 3/026 | 172/170 |
| 5,177,415 | A * | 1/1993 | Quibel | E01C 19/288 | 318/128 |
| 5,248,216 | A * | 9/1993 | Vural | B06B 1/166 | 404/117 |
| 5,676,493 | A * | 10/1997 | Brockway | A01B 71/08 | 404/121 |
| 5,781,874 | A * | 7/1998 | Troppman | E01C 19/288 | 404/117 |
| 7,148,682 | B2 * | 12/2006 | Becker | G01R 33/0094 | 324/244 |
| 9,139,965 | B1 * | 9/2015 | Frelich | E01C 19/288 | |
| 9,915,040 | B2 * | 3/2018 | Bletscher | E01C 19/004 | |
| 10,571,280 | B2 * | 2/2020 | Pratt | G01S 7/412 | |

(Continued)

FOREIGN PATENT DOCUMENTS

| | | | | |
|---|---|---|---|---|
| CN | 207619791 | | 7/2018 | |
| CN | 110258260 | * | 9/2019 | E01C 19/26 |
| CN | 110331639 | | 10/2019 | |

*Primary Examiner* — Raymond W Addie

(74) *Attorney, Agent, or Firm* — Schwegman, Lundberg & Woessner

(57) ABSTRACT

A soil compactor machine can include a machine frame; at least one cylindrical roller drum rotatably coupled to the machine frame and rotatable about a drum axis oriented generally transverse to a direction of travel of the compactor machine; and a radar sensor mounted to a front portion of the machine frame and positioned forward of the roller drum, wherein the radar sensor is mounted to the machine frame by a sensor bracket configured to directly mount to the machine frame for both a blade and a non-blade soil compactor machine configuration.

20 Claims, 7 Drawing Sheets

(56) References Cited

U.S. PATENT DOCUMENTS

| | | | | |
|---|---|---|---|---|
| 2020/0023788 | A1* | 1/2020 | Frederick | G01S 7/02 |
| 2020/0108511 | A1* | 4/2020 | Inoue | B25J 13/088 |
| 2021/0124051 | A1* | 4/2021 | Lu | H04N 5/2253 |

* cited by examiner

AUTONOMOUS SOIL COMPACTOR FRONT RADAR

TECHNICAL FIELD

This disclosure relates to road construction equipment, and more specifically to a compactor machine with a roller drum for traveling over a surface to be compacted.

BACKGROUND

Compactors are machines used to compact initially loose materials, such as asphalt, soil, gravel, and the like, to a densified and more rigid mass or surface. For example, soil compactors are utilized to compact soil at construction sites and on landscaping projects to produce a foundation on which other structures may be built. Most soil compactors include a rotatable roller drum that may be rolled over the surface to compress the material underneath. In addition to utilizing the weight of the roller drum to provide the compressive forces that compact the material, some compactors are configured to also induce a vibratory force to the surface. Soil compactors can be provided with a blade or without a blade. Providing a blade allows soil to be pushed ahead of the soil compactor as the compactor moves forward. Autonomous machines are machines that use a variety of sensors to detect the area around a machine so that the machine can operate without a driver or can be used to assist the driver while they operate the machine.

A front radar sensor can be part of an object detection system on an autonomous soil compactor. However, it can be difficult to determine the best location for the sensor, as many factors have to be looked at such as detection start and end distances, reflection angles, horizontal field of views and environmental conditions.

CN110331639 discusses an autonomous roller having a body-mounted millimeter-wave radar to detect obstacles around the vehicle body.

SUMMARY

In an example according to this disclosure, a soil compactor machine can include a machine frame; at least one cylindrical roller drum rotatably coupled to the machine frame and rotatable about a drum axis oriented generally transverse to a direction of travel of the compactor machine; and a radar sensor mounted to a front portion of the machine frame and positioned forward of the roller drum, wherein the radar sensor is mounted to the machine frame by a sensor bracket configured to directly mount to the machine frame for either a blade or non-blade soil compactor machine configuration.

In another example, a radar sensor assembly for autonomous soil compactor machine can include: a radar sensor; and a sensor bracket mountable to a front portion of a machine frame of the soil compactor machine and positioned forward of a roller drum of the soil compactor machine, wherein the sensor bracket is configured to directly mount to the machine frame for both a blade and non-blade soil compactor machine configuration.

In another example according to the present disclosure, a method of mounting a radar sensor assembly to an autonomous soil compactor machine can include: providing a sensor bracket for holding a radar sensor, wherein the sensor bracket is configured to be mounted to a machine frame of the soil compacting machine for both a blade and a non-blade soil compactor machine configuration, the sensor bracket including a sensor holding portion and a removable angled bracket; and if the machine includes a blade, attaching the removable angled bracket to a lower surface of the sensor holding portion and mounting the angled bracket to a blade cylinder mount of the soil compactor machine; and if the machine does not have a blade, attaching the sensor holding portion directly to a front bumper of the soil compactor machine using bolts.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
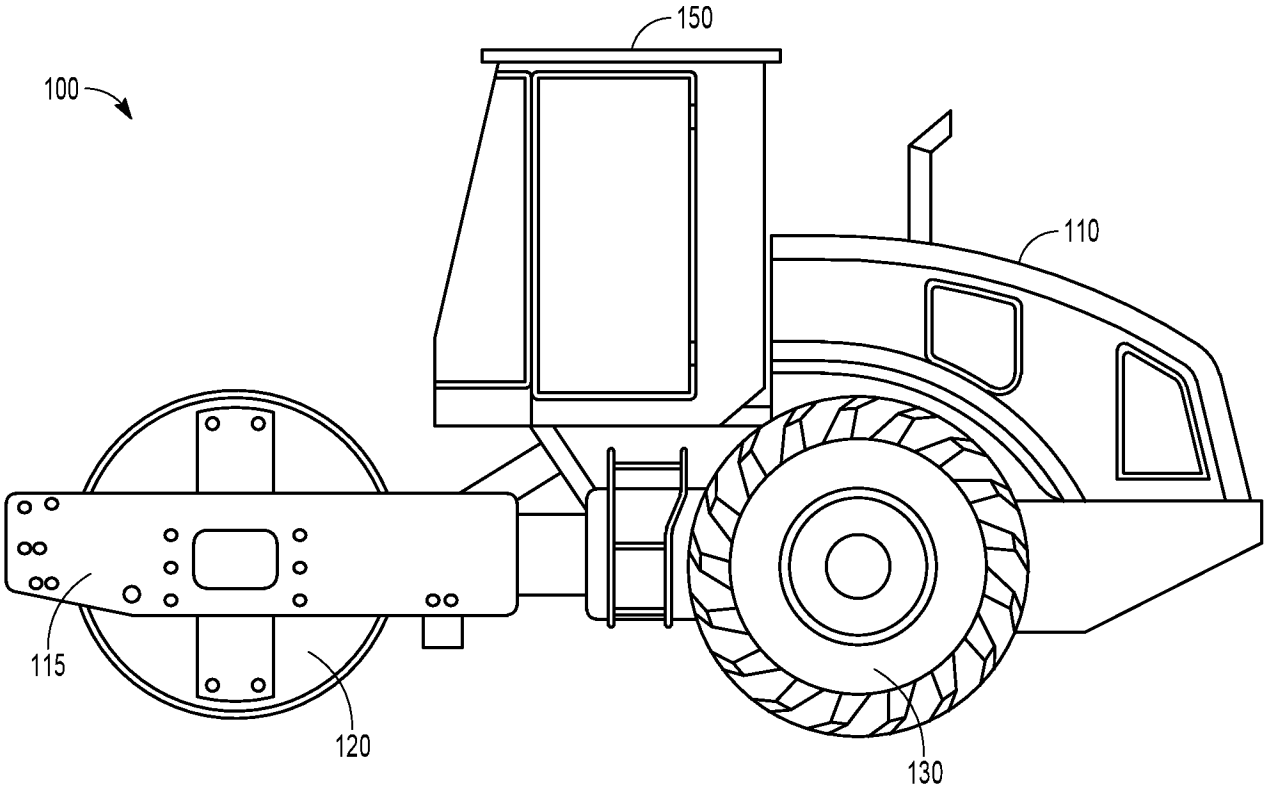
FIG. 1 shows a side view of a compactor machine without a blade, in accordance with one embodiment.

FIG. 1 shows a side view of a soil compactor machine 100, in accordance with one embodiment. The compactor machine 100 generally includes a body or machine frame 110 that connects and associates the various physical and structural features that enable the compactor machine 100 to function. These features can include an operator's cab 150 that is mounted on top of the machine frame 110 from which an operator may control and direct operation of the compactor machine 100. Accordingly, a steering feature and similar controls may be located within the operator's cab 150. To propel the compactor machine 100 over the surface, a power system such as an internal combustion engine can also be mounted to the machine frame 110 and can generate power that is converted to physically move the machine.

The compactor machine 100 can include a cylindrical roller drum 120 which is rotatable about a drum axis oriented generally transverse to a direction of travel of the compactor machine 100. The roller drum 120 is attached to the machine frame 110 using respective drum supports 115, 117 (not shown). In this example, the compactor machine 100 articulates such that the front section including the cylindrical drum 120 can articulate relative to the back section including wheels 130

Figure 2:
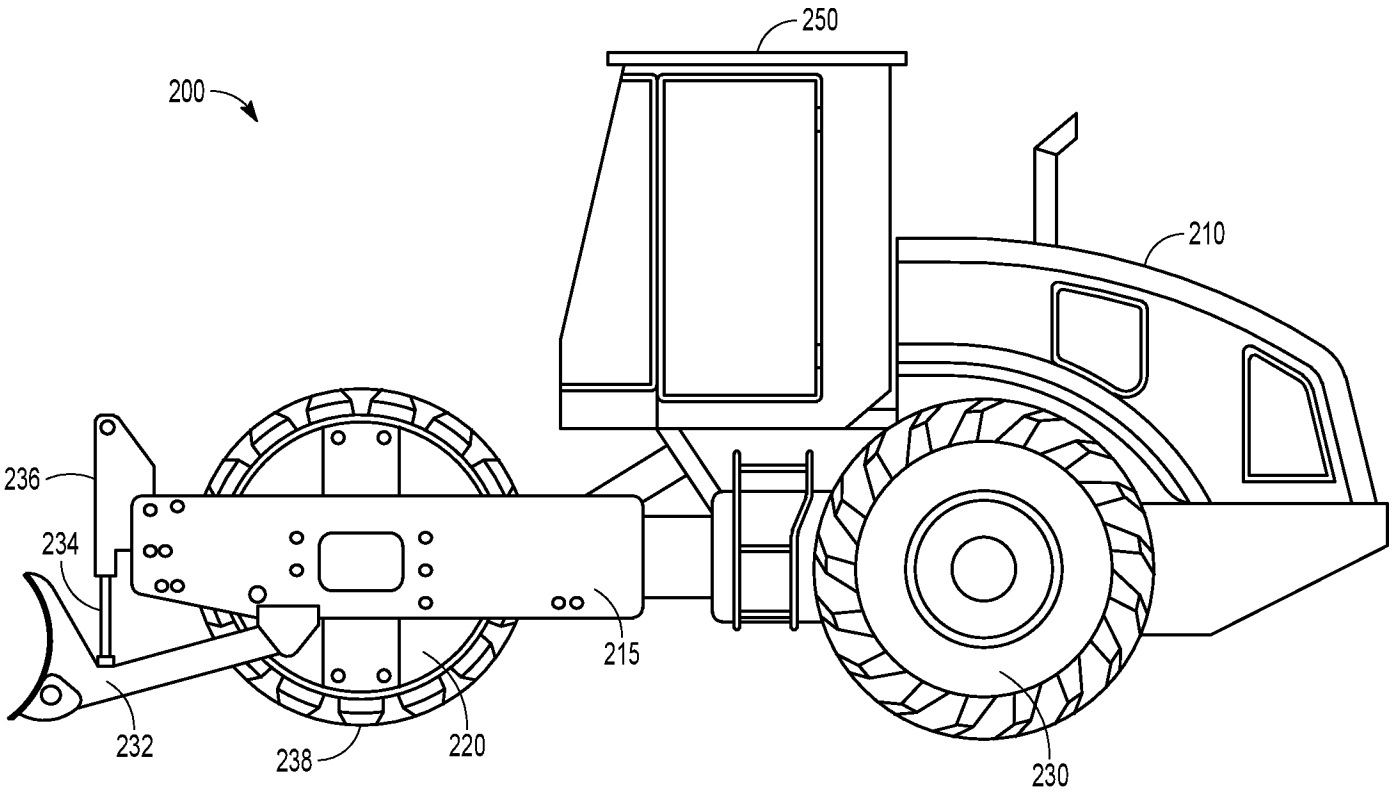
FIG. 2 shows a side view of a compactor machine with a blade, in accordance with one embodiment.

FIG. 2 shows a side view of a soil compactor machine 200 with a blade, in accordance with one embodiment.

Here, the soil compactor machine 200 includes a machine frame 210, a cylindrical roller drum 220 including surface knobs. The cylindrical roller drum 220 is rotatably coupled to the machine frame 210 and rotatable about a drum axis oriented generally transverse to a direction of travel of the compactor machine 200.

The roller drum 220 is attached to the machine frame 210 using respective drum supports 215, 217 (not shown). In this example, the compactor machine 200 includes a cab 250. The compactor machine 200 articulates such that the front section including the cylindrical drum 220 can articulate relative to the back section including wheels 230

Soil compactor machine 200 further includes a plow blade 232. The blade 232 is pivotally attached to the frame 210 at pivot connection 238 located on the drum support 215 and drum support 217 (not shown). A hydraulic cylinder 234 is mounted to the blade 232 to raise and lower the blade 232 as needed. The cylinder 234 is mounted to a blade cylinder mount 236 that is mounted to the frame 210 at a front bumper of the machine.

Both of the soil compactor machines 100 and 200 can be configured to be autonomous or semi-autonomous machines. Thus, the machines 100 and 200 can include various sensors and controllers to provide autonomous control of the machine.

For example, as noted above, a front radar sensor can be part of an object detection system on an autonomous soil compactor. However, it can be difficult to determine the best location for the sensor, as many factors have to be looked at such as detection start and end distances, reflection angles, horizontal field of views and environmental conditions. Moreover, in the soil compactor machines 100 and 200, it can be difficult to find a radar mounting solution that can be common to both machines due to the addition of the blade 232 for machine 200.

As will be discussed in more detail below, the present system mounts a radar sensor, using a common sensor bracket, to the blade cylinder mount 236 on the machine 200 with the blade attachment, and to the front bumper for the machine 100 without a blade.

Figure 3:
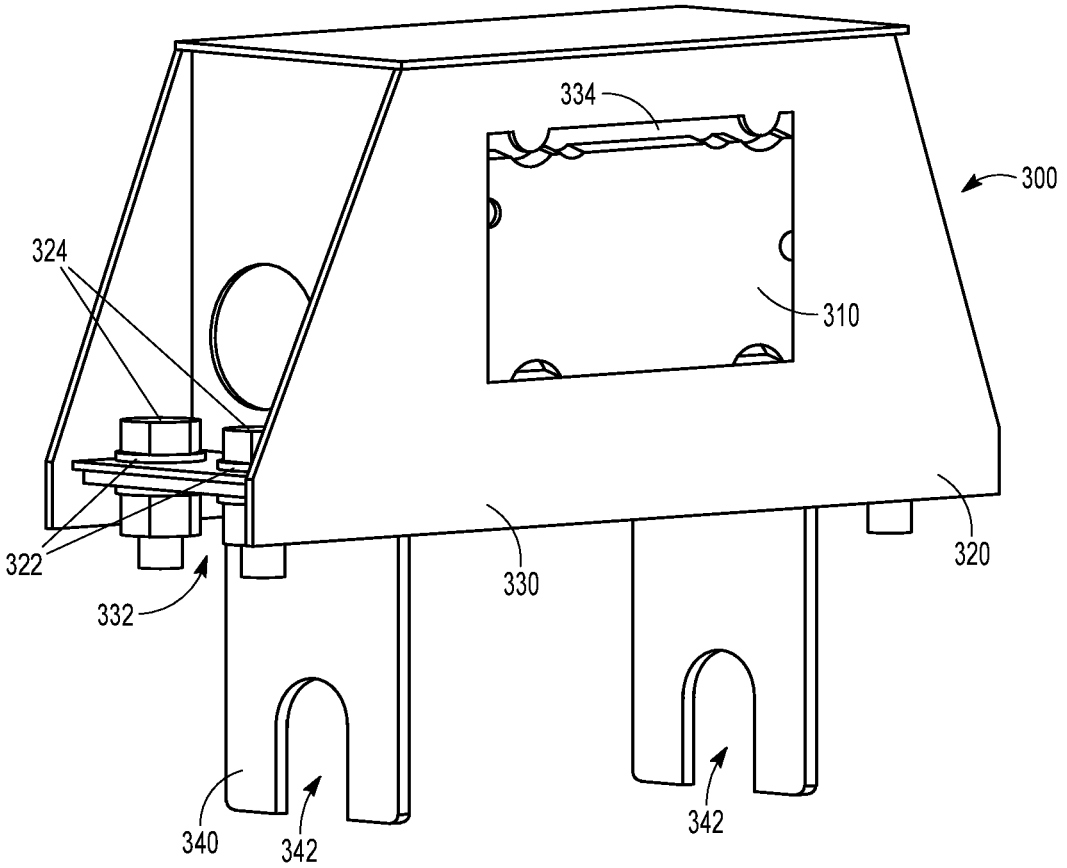
FIG. 3 shows a perspective view of a sensor assembly, in accordance with one embodiment.

FIG. 3 shows a perspective view of a radar sensor assembly 300, in accordance with one embodiment. The radar sensor assembly 300 includes a radar sensor 310 mounted within a sensor bracket 320. The sensor bracket 320 can include a sensor holding portion 330 including mounting apertures 322 on first and second sides of the sensor holding portion 330 which are configured to mount to a front bumper of a soil compactor machine using mounting bolts 324. The sensor bracket 320 further includes a removable angled bracket 340 attachable to a lower surface 332 of the sensor holding portion 330 using the bolts 324. The angled bracket 340 can include mounting apertures 342 to mount to a blade cylinder mount of a machine with a blade. The sensor holding portion 330 of the sensor bracket 320 can include an open front window 334 configured to allow the radar sensor 310 to be exposed through the open front window 334 on a front surface of the sensor holding portion 330.

As will be discussed below, the sensor bracket 320 allows the radar sensor 310 to be mounted to a front portion of a compactor machine and positioned forward of the roller drum and positioned as low as possible for either a blade or non-blade configuration. This allows for improved detection start and end distances, reflection angles, and horizontal field of views, and allows the sensor to articulate with the machine. For example, depending on the machine, the sensor can be positioned lower than a top surface of the roller drum for either a blade or non-blade configuration. For some machines with a blade, the top of the blade cylinder mount may be so high that the sensor will be located slightly higher than the top of the roller drum.

Figure 4:
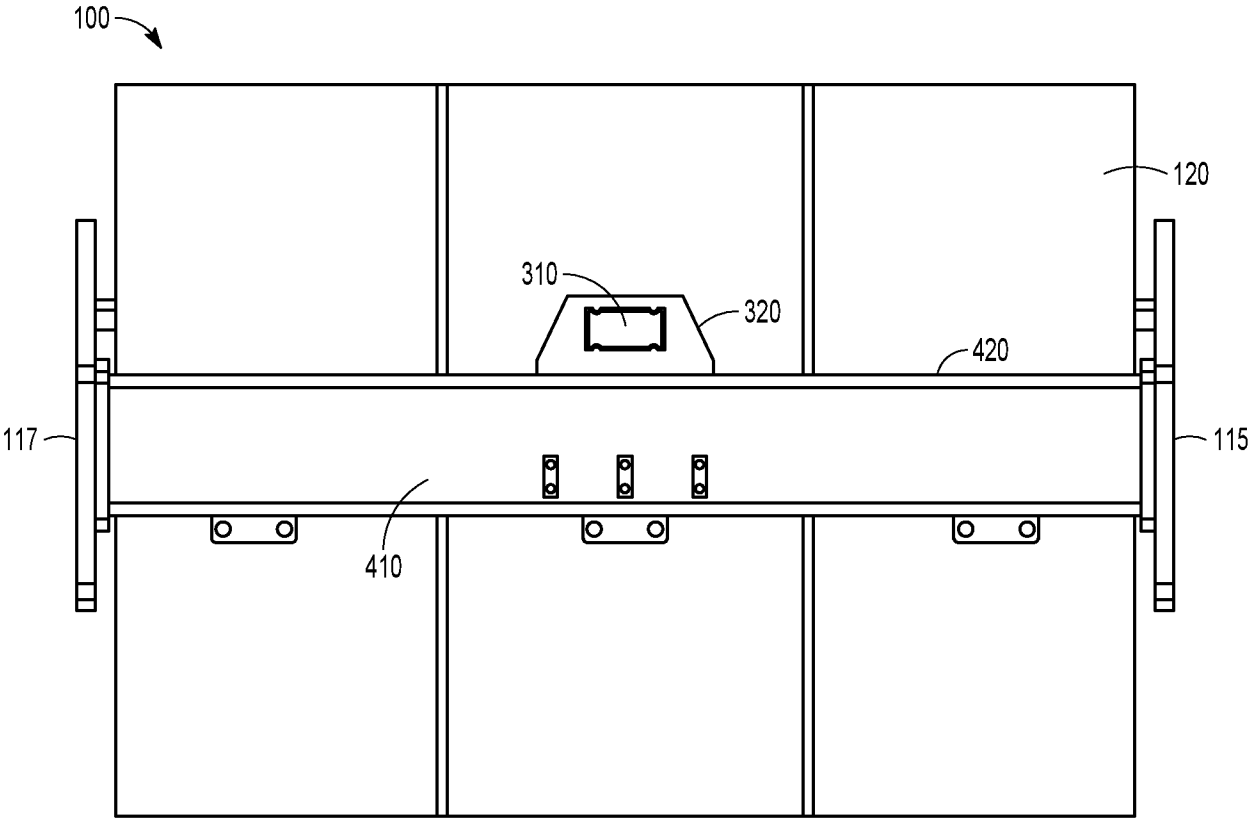
FIG. 4 shows a front view of the sensor assembly mounted to the front of a compactor machine without a blade, in accordance with one embodiment.
Figure 5:
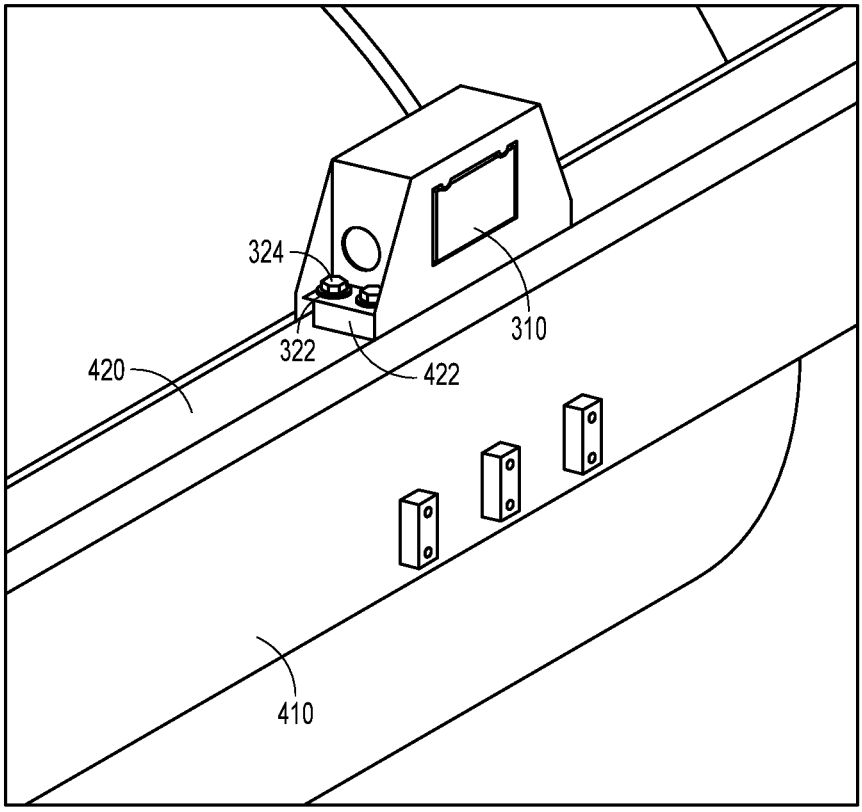
FIG. 5 shows a perspective view of the sensor assembly mounted to the front of a compactor machine without a blade, in accordance with one embodiment.

Referring now also to FIGS. 4 and 5, the details of mounting the sensor bracket 320 to the machine 100 will be discussed. FIG. 4 shows a front view of the sensor assembly mounted to the front of the compactor machine 100 without a blade, in accordance with one embodiment, and FIG. 5 shows a perspective view of the sensor assembly mounted to the front of the compactor machine without a blade. The machine 100 further includes a front bumper 410 which extends between drum supports 115, 117. Here, the removable angled bracket 340 of the sensor bracket 320 is removed and the sensor bracket 320 is mounted directly to a top surface 420 of a front bumper 410 using bolts 324 which extend through apertures 322 on the sides of the sensor holding portion 330.

Accordingly, when the soil compactor machine 100 does not include a blade, the sensor bracket 320 can mounted to the top surface 420 of the front bumper 410 of the soil compactor machine 110. Here, the bolts 324 can be coupled to one or more weld blocks 422 which are welded to the top surface 420 of the front bumper 410.

Figure 6:
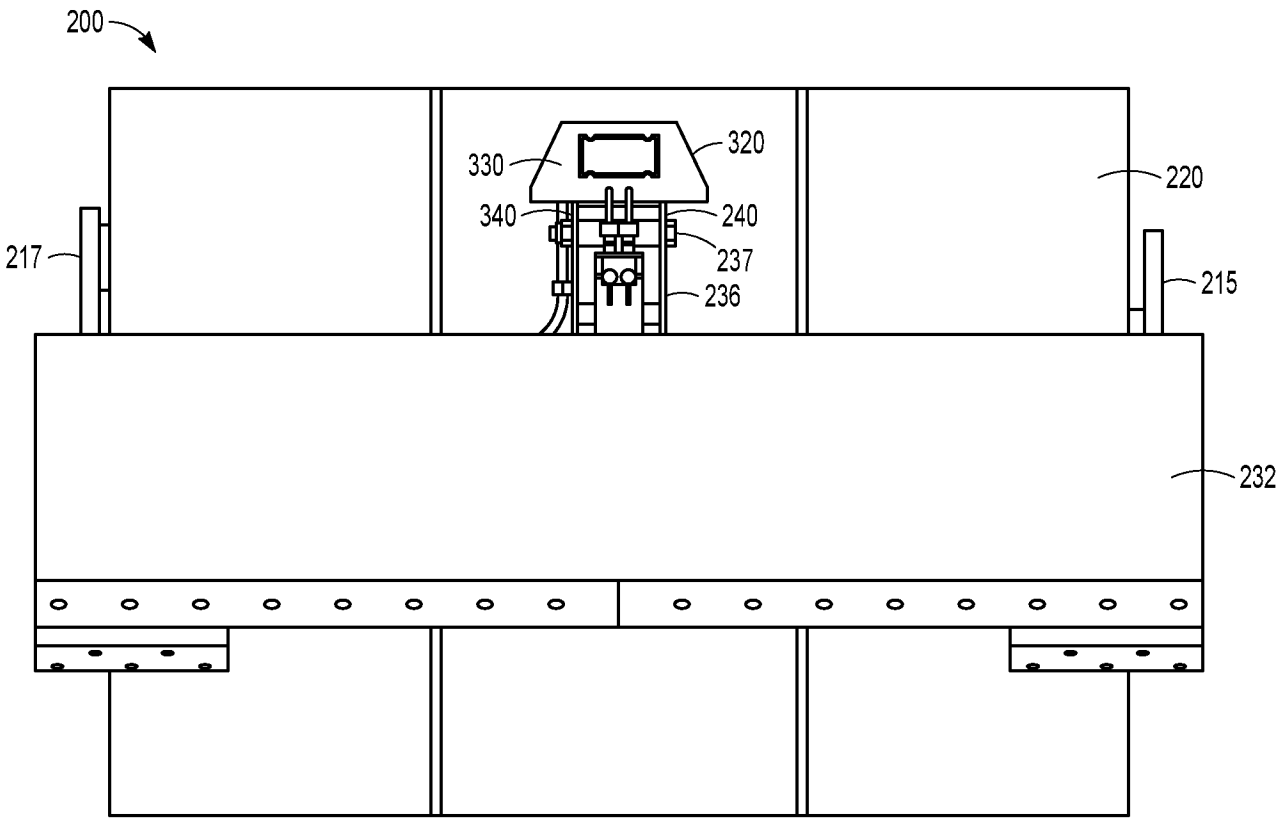
FIG. 6 shows a front view of the sensor assembly mounted to the front of a compactor machine with a blade, in accordance with one embodiment.
Figure 7:
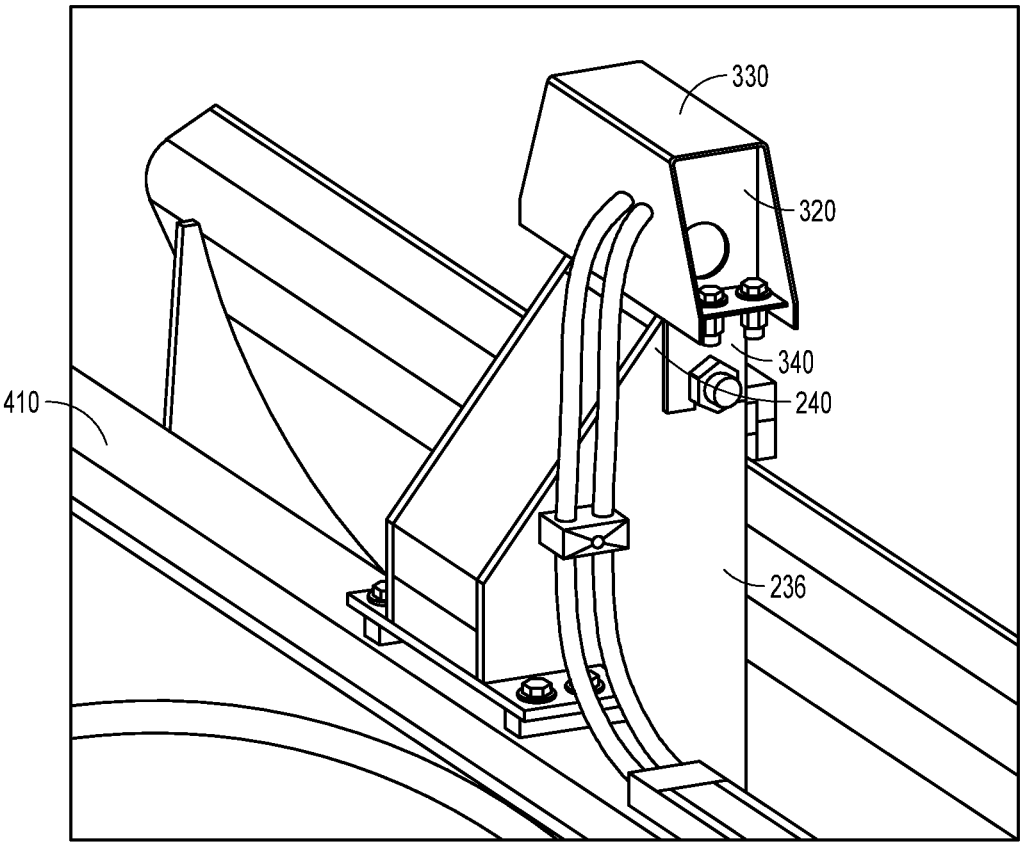
FIG. 7 shows a perspective view of the sensor assembly mounted to the front of a compactor machine with a blade, in accordance with one embodiment.

FIG. 3 and FIGS. 6 and 7 will be referred to for a discussion of mounting the sensor assembly 330 to a compactor with a blade. FIG. 6 shows a front view of the sensor assembly 330 mounted to the front of the compactor machine 200 with a blade 232, in accordance with one embodiment, and FIG. 7 shows a perspective view of the sensor assembly 330 mounted to the front of the compactor machine with a blade. In this embodiment, the removable angled bracket 340 is mounted to the lower surface 332 of the sensor holding assembly 330 using the bolts 324. The angled bracket 340 includes mounting apertures 342 to mount to the blade cylinder mount 236. In this example, the removable angled bracket 340 mounting apertures 342 are open at a bottom of the removable angled bracket 340.

Accordingly, to mount the sensor bracket 320 to the blade cylinder mount 236, a bolt 237 located in the upper portion 240 of the blade cylinder mount 236 is loosened and the mounting apertures 342 can slip over the bolt 237. The bolt 237 is then tightened. This positions the sensor assembly 330 at the top of the blade cylinder mount 236 such that the sensor bracket 320 is mounted to the upper portion 240 of a blade cylinder mount 236. This location allows the sensor assembly to articulate with the machine while not being obstructed by the blade 232 as the blade is raised.

Overall, the sensor bracket 320 includes the sensor holding portion 330 including the mounting apertures 322 on first and second sides of the sensor holding portion 330 which are configured to mount to the front bumper 410 using bolts 324. The sensor bracket 320 further includes the removable angled bracket 340 which is attachable to a lower surface 332 of the sensor holding portion 330. The angled bracket 340 including mounting apertures 342 to mount to a blade cylinder mount 236.

Thus, the radar sensor 310 can be directly mounted to either machine frame 110 or 210 by the sensor bracket 320 which is configured to directly mount to either the machine frame 110, 210 for either a blade or non-blade soil compactor machine configuration. This allows for a common bracket that optimally mounts to the machine for either a blade or non-blade configuration.

Thus, regardless of the soil compactor blade configuration, this system provides improved start and ending detection distances, and has a great distance to drum obstructions. Since the radar sensor is mounted low on the machine it has a good reflection angle and spans a large area horizontally and vertically. Moreover, the radar sensor also articulates with the machine.

INDUSTRIAL APPLICABILITY

The present system is applicable during many situations in road construction and especially for soil compactors. As discussed, it is useful for a radar mounting system that allows for a properly positioned radar sensor for both a blade or non-blade configuration The present system attaches the radar sensor to the blade cylinder mount on a machine with a blade attachment, and the front bumper for a machine without a blade. Referring to the compactor machines of FIGS. 1-7, a method of mounting a radar sensor assembly 300 to an autonomous soil compactor machine having a blade assembly or not having a blade assembly can include: providing a sensor bracket 320 for holding a radar sensor 310, wherein the sensor bracket 320 is configured to be mounted to a machine frame 110, 210 of the soil compacting machine for both a blade or non-blade soil compactor machine configuration. The sensor bracket 320 can include a sensor holding portion 330 and a removable angled bracket 340.

If the machine includes a blade, the method includes attaching the removable angled bracket 340 to a lower surface of the sensor holding portion 330 and mounting the angled bracket 340 to a blade cylinder mount 236 of the soil compactor machine.

If the machine does not have a blade, the method includes attaching the sensor holding portion 330 directly to a front bumper 410 of the soil compactor machine using bolts.

Various examples are illustrated in the figures and foregoing description. One or more features from one or more of these examples may be combined to form other examples.

The above detailed description is intended to be illustrative, and not restrictive. The scope of the disclosure should, therefore, be determined with references to the appended claims, along with the full scope of equivalents to which such claims are entitled.

What is claimed is:

1. A soil compactor machine comprising:

a machine frame;

at least one cylindrical roller drum rotatably coupled to the machine frame and rotatable about a drum axis oriented generally transverse to a direction of travel of the compactor machine; and a radar sensor mounted to a front portion of the machine frame and positioned forward of the roller drum, wherein the radar sensor is mounted to the machine frame by a sensor bracket configured to directly mount to the machine frame for both a blade and a non-blade soil compactor machine configuration, wherein the sensor bracket includes a sensor holding portion including mounting apertures on first and second sides of the sensor holding portion configured to mount to a front bumper using bolts and the sensor bracket includes a removable angled bracket attachable to a lower surface of the sensor holding portion.

2. The soil compactor machine of claim 1, wherein the radar sensor is mounted to the machine frame such that the radar sensor is lower than a top surface of the roller drum.

3. The soil compactor machine of claim 1, wherein the soil compactor machine does not include a blade and the sensor bracket is mounted to a top surface of a front bumper of the soil compactor machine.

4. The soil compactor machine of claim 1, wherein the soil compactor machine includes a blade and wherein the sensor bracket is mounted to an upper portion of a blade cylinder mount.

5. The soil compactor machine of claim 1, wherein the removable includes mounting apertures to mount to a blade cylinder mount.

6. The soil compactor machine of claim 5, wherein the removable angled bracket mounting apertures are open at a bottom of the removable angled bracket.

7. The compactor machine of claim 1, wherein the sensor bracket is mounted to the machine frame such that the radar sensor articulates with the soil compactor machine.

8. The compactor machine of claim 1, wherein the sensor holding portion of the sensor bracket includes an open front window configured to allow the radar sensor to be exposed through the open front window.

9. The compactor machine of claim 1, wherein the soil compactor machine is configured to be an autonomous machine.

10. A radar sensor assembly for autonomous soil compactor machine, the radar sensor assembly comprising:

a radar sensor; and a sensor bracket mountable to a front portion of a machine frame of the soil compactor machine and positioned forward of a roller drum of the soil compactor machine, wherein the sensor bracket is configured to directly mount to the machine frame for both a blade and non-blade soil compactor machine configuration, wherein the sensor bracket includes a sensor holding portion including mounting apertures on first and second sides of the sensor holding portion configured to mount to a front bumper of the soil compactor machine using bolts.

11. The radar sensor assembly of claim 10, wherein the sensor bracket includes a removable angled bracket attachable to a lower surface of the sensor holding portion, the angled bracket including mounting apertures to mount o a blade cylinder mount of the soil compactor machine.

12. The radar sensor assembly of claim 11, wherein the sensor holding portion of the sensor bracket includes an open front window configured to allow the radar sensor to be exposed through the open front window.

13. The radar sensor assembly of claim 12, wherein the radar sensor is mounted to the machine frame such that the radar sensor is lower than a top surface of a roller drum of the soil compactor machine.

14. The radar sensor assembly of claim 12, wherein the soil compactor machine does not include a blade and the sensor bracket is mounted to a top surface of the front bumper.

15. The radar sensor assembly of claim 12, wherein the soil compactor machine includes a blade and wherein the sensor bracket is mounted to an upper portion of the blade cylinder mount.

16. The radar sensor assembly of claim 12, wherein the removable angled bracket mounting apertures are open at a bottom of the removable angled bracket.

17. The radar sensor assembly of claim 12, wherein the bracket sensor is mounted to the machine frame such that the radar sensor articulates with the soil compactor machine.

18. A method of mounting a radar sensor assembly to an autonomous soil compactor machine, the method comprising:

providing a sensor bracket for holding a radar sensor, wherein the sensor bracket is configured to be mounted to a machine frame of the soil compactor machine for both a blade and a non-blade soil compactor machine configuration, the sensor bracket including a sensor holding portion and a removable angled bracket, wherein the sensor bracket includes a sensor holding portion including mounting apertures on first and second sides of the sensor holding portion configured to mount to a front bumper of the soil compactor machine using bolts and the sensor bracket includes a removable angled bracket attachable to a lower surface of the sensor holding portion, the angled bracket including mounting apertures to mount to a blade cylinder mount of the soil compactor machine; and if the machine includes a blade, attaching the removable angled bracket to the lower surface of the sensor holding portion and mounting the angled bracket to the blade cylinder mount of the soil compactor machine; and if the machine does not have a blade, attaching the sensor holding portion directly to the front bumper of the soil compactor machine using bolts.

19. The method of claim 18, wherein the radar sensor is mounted to the machine frame such that the radar sensor articulates with the soil compactor machine.

20. The method of claim 18, wherein the radar sensor is mounted to the machine frame such that the radar sensor is lower than a top surface of a roller drum of the autonomous soil compactor machine.

* * * * *